US012584502B2

(12) United States Patent
Reilly et al.

(10) Patent No.: US 12,584,502 B2
(45) Date of Patent: Mar. 24, 2026

(54) FAN ASSEMBLY

(71) Applicant: Dyson Technology Limited, hire (GB)

(72) Inventors: Philip Tennison Reilly, Gloucester (GB); Jesal Bipin Patel, Bristol (GB)

(73) Assignee: Dyson Technology Limited, Malmesbury (GB)

( * ) Notice: Subject to any disclaimer, the term of this patent is extended or adjusted under 35 U.S.C. 154(b) by 0 days.

(21) Appl. No.: 18/836,790

(22) PCT Filed: Mar. 2, 2023

(86) PCT No.: PCT/GB2023/050481
§ 371 (c)(1),
(2) Date: Aug. 8, 2024

(87) PCT Pub. No.: WO2023/166299
PCT Pub. Date: Sep. 7, 2023

(65) Prior Publication Data

US 2025/0146512 A1 May 8, 2025

(30) Foreign Application Priority Data

Mar. 4, 2022 (GB) ..... 2203019

(51) Int. Cl.
*F04F 5/16* (2006.01)
*F04F 5/46* (2006.01)
*F04F 5/48* (2006.01)

(52) U.S. Cl.
CPC ..... *F04F 5/16* (2013.01); *F04F 5/46* (2013.01); *F04F 5/48* (2013.01)

(58) Field of Classification Search
CPC ..... F04D 17/12; F04D 17/122; F04D 25/06; F04D 27/003; F04D 27/009;
(Continued)

(56) References Cited

U.S. PATENT DOCUMENTS 10,094,392 B2 * 10/2018 Poulton ..... F04D 29/54
11,067,089 B2 * 7/2021 Kim ..... F24F 1/0029
(Continued)

FOREIGN PATENT DOCUMENTS

EP 2548805 A2 1/2013
EP 2613055 A1 7/2013
(Continued)

*Primary Examiner* — Jesse S Bogue
(74) *Attorney, Agent, or Firm* — Tucker Ellis LLP; Michael G. Craig

(57) ABSTRACT

A fan assembly comprising an airflow generator and a nozzle. The nozzle comprising a body defining an air inlet to receive generated airflow, an air outlet section, and a switching member. The switching member switches between a first position, delivering only a first airflow to the outlet, and a second position, delivering both first and second airflows. The air outlet section comprises a first inlet for the first airflow, a second inlet for the second airflow, an air outlet for emitting airflow from the fan assembly, and pathways between the first inlet and the air outlet. In the first position, the first airflow travels along the first pathway and is emitted in a first outlet direction. In the second position, the second airflow interacts with the first, redirecting it along the second pathway, and emitting it in a second, different outlet direction.

16 Claims, 5 Drawing Sheets

(58) Field of Classification Search
CPC .. F04D 29/0513; F04D 29/056; F04D 29/057; F04D 29/4206; F04D 29/58; F04D 29/584; F04D 25/08; F04D 25/10; F04D 29/441; F04D 29/541; F04F 5/16; F04F 5/46; F04F 5/48; F05D 2250/52; F24F 13/08
See application file for complete search history.

(56) References Cited

U.S. PATENT DOCUMENTS

| | | | | |
|---|---|---|---|---|
| 11,187,240 | B2 * | 11/2021 | Ku | F04D 25/06 |
| 11,486,413 | B2 * | 11/2022 | Jukes | F04D 25/08 |
| 11,767,859 | B2 * | 9/2023 | Peet | F04D 25/10 415/148 |
| 11,773,871 | B2 * | 10/2023 | Lee | F24F 13/12 415/148 |
| 2012/0034108 | A1 * | 2/2012 | Wallace | F24H 9/0063 417/313 |
| 2014/0084492 | A1 * | 3/2014 | Staniforth | F04D 25/08 261/31 |
| 2014/0255173 | A1 * | 9/2014 | Poulton | F24F 7/007 415/182.1 |
| 2018/0274794 | A1 * | 9/2018 | Song | F24F 1/0011 |
| 2019/0170157 | A1 * | 6/2019 | Mogridge | F04D 25/08 |
| 2019/0170162 | A1 * | 6/2019 | Jennings | F04D 19/002 |
| 2021/0270283 | A1 * | 9/2021 | Macqueen | F04F 5/46 |

FOREIGN PATENT DOCUMENTS

| | | | |
|---|---|---|---|
| EP | 2737216 | A2 | 6/2014 |
| EP | 3091296 | A1 | 11/2016 |
| EP | 3677790 | A1 | 7/2020 |
| JP | 5234152 | B2 | 7/2013 |
| JP | 2022510452 | A | 1/2022 |

* cited by examiner

FAN ASSEMBLY

RELATED APPLICATION DATA

This application is a national phase application of International Application No. PCT/GB2023/050481 filed Mar. 2, 2023, which claims priority to GB Application No. 2203019.1 filed Mar. 4, 2022.

FIELD OF THE INVENTION

The present invention relates to a fan assembly and a nozzle for a fan assembly.

BACKGROUND OF THE INVENTION

Conventional domestic fans that are used for the purposes of thermal comfort and/or environmental or climate control generate an airflow to provide a cooling sensation. The movement and circulation of the air flow creates a 'wind chill' or breeze and, as a result, the user experiences a cooling effect as heat is dissipated through convection and evaporation. Other air treatment devices used for the purposes of user comfort also generate an airflow to provide treated airflow, for example a heated, scented, or ionised airflow.

In some instances, a user may wish to experience a greater or lesser air treatment sensation in their vicinity, such as a level of heating, cooling, humidification and/or purification. In some known devices, this is achieved by changing the direction of airflow from a fan to be directed towards or away from a user.

SUMMARY OF THE INVENTION

According to a first aspect of the present invention, there is provided a fan assembly comprising an airflow generator to generate an airflow, and a nozzle comprising: a nozzle body defining an air inlet to receive the airflow generated by the airflow generator into the nozzle body, an air outlet section defined in the nozzle body, and a switching mechanism switchable between a first position in which only a first airflow is delivered to the air outlet section, and a second position in which the first airflow and a second airflow are delivered to the air outlet section. The air outlet section comprises a first inlet through which the first airflow passes, a second inlet through which the second airflow passes, an air outlet for emitting airflow from the fan assembly, and first and second air pathways between the first inlet and the air outlet. When the switching member is in the first position, the first airflow passes along the first air pathway and is emitted from the air outlet in a first outlet direction, and, when the switching member is in the second position, the second airflow interacts with the first airflow to cause the first airflow to pass along the second air pathway, and the first airflow is emitted from the air outlet in a second, different outlet direction.

The fan assembly according to the first aspect of the present invention may be advantageous as the inventors of the present application have determined that, by providing the first and second inlets and the switching mechanism, a direction of airflow exiting the fan assembly can be modified without any outwardly visible moving parts. This may provide a safer and more simple fan assembly compared to a fan assembly with external moving parts.

The fan assembly according to the first aspect of the present invention may be advantageous as the inventors of the present application have determined that, by providing the first and second inlets and the switching mechanism, a different airflow profile may be delivered to a user of the fan assembly from the same air outlet.

When the switching member is in the second position, the second airflow may collide with the first airflow in a direction substantially perpendicular to the first airflow. This may help the second airflow to deflect the first airflow such that the first airflow passes along the second air pathway. This may help to deflect the first airflow with a lesser flow rate of the second airflow, compared to a fan assembly wherein the second airflow collides with the first airflow in a non-perpendicular direction, which may in turn help to reduce an amount of dilution of the first airflow by the second airflow.

The second inlet may be in the form of a slot, for example a slot having a length that is at least 10 times longer than its width. This may help to increase a velocity of the second airflow as it passes through the second inlet, which may in turn help the second airflow to deflect the first airflow such that the first airflow passes along the second air pathway.

The first inlet may have a greater cross-sectional area than the second inlet such that, when the switching mechanism is in the second position, a velocity of the second airflow is greater than a velocity of the first airflow when the second airflow interacts with the first airflow. For example, a cross-sectional area of the first inlet may be at least five times greater than a cross-sectional area of the second inlet. This may help the second airflow to deflect the first airflow such that the first airflow passes along the second air pathway. This may help to reduce an amount of dilution of the first airflow by the second airflow compared to a fan assembly wherein the second inlet has a cross-sectional area that is substantially equal to or greater than a cross-sectional area of the first inlet.

When the switching member is in the second position, a flow rate of the second airflow may be no more than 10% of a flow rate of the first airflow. This may help to reduce dilution of the first airflow by the second airflow compared to a fan assembly wherein the flow rate of the second airflow is greater than 10% of a flow rate of the first airflow.

The air outlet section may comprise a chamber between the first inlet and the air outlet, the chamber delimited by at least two walls. The at least two walls of the chamber may comprise first and second walls extending downstream of the first inlet and diverging from one another, the first wall forming part of the first pathway and the second wall forming part of the second pathway such that, when the switching member is in the first position, the first airflow passes along the first wall and, when the switching member is in the second position, the first airflow passes along the second wall. Thus, the at least two walls of the chamber may help to guide the first airflow along the respective first or second air pathway towards the air outlet.

The air outlet section may comprise a curved inlet surface extending from the first inlet to the first wall, the curved inlet surface configured to encourage the first airflow to pass along the first air pathway. For example, the curved inlet surface may comprise a Coanda surface to generate a force to attract the first airflow toward the curved surface inlet. This may help to provide a more laminar flow of the first airflow as is passes from the first inlet into the chamber. Provision of the curved surface may negate a need for moving parts in the air outlet section to direct the first airflow towards the first or second air pathway.

The at least two walls of the chamber may comprise third and fourth walls converging relative to one another towards the air outlet. This may allow the first and second airflow pathways to end at the same air outlet, which may comprise a single aperture through which the first airflow passes irrespective of whether the first airflow has passed along the first or second air pathway. This may help to prevent the first airflow from diverging before it passes through the air outlet.

The third and fourth walls may be connected to the first and second walls, respectively to form substantially smooth surfaces between the first inlet and the air outlet along which the first airflow passes. This may help to maintain laminar flow of the first airflow.

The air outlet section may comprise an island located in the chamber and spaced apart from the at least two walls, and the island may be configured such that a first side of the island forms part of the first air pathway and the first air pathway passes around the island in a first direction, and a second, opposing side of the island forms part of the second air pathway and the second air pathway passes around the island in a second direction. This may provide a space-efficient and simple way of providing a physical barrier between the first and second air pathways, which in turn may help to provide reliable first and second outlet directions of the first airflow.

The island may be of sufficient size so as to block a line-of-sight by a user from the air outlet to the first inlet. That is, the island may have a maximum height that is greater than a height of the air outlet. This may provide a safety benefit of a user not having visibility of the inner workings of the fan assembly.

A distal end of each of the third and fourth walls, that is an end of the third and fourth walls that is further from the first inlet than an opposite, proximal end of the third and fourth walls, may be downstream of the island. This may help to prevent access to the inner workings of the fan assembly by a user. This may also allow the third and fourth walls to direct the first airflow in the first or second outlet direction.

The first side of the island may comprise a first curved surface across which the first airflow flows as it passes along the first air pathway, the first curved surface configured to generate a first force to attract the first airflow toward the first curved surface. The second side of the island may comprise a second curved surface across which the first airflow flows as it passes along the second air pathway, the second curved surface configured to generate a second force to attract the first airflow toward the second curved surface. For example, the first and second curved surfaces may comprise Coanda surfaces. The curved surfaces of the island may help to maintain laminar flow of the first airflow as it passes along the first and second air pathways, which may in turn provide a more desirable airflow profile to a user of the fan assembly.

The air outlet section may comprise a step located on the second wall; the step configured to encourage the first airflow to pass along the first air pathway. For example, the step may be positioned on a substantially opposite side of the first inlet to the curved inlet surface. The step may encourage the first airflow towards the first wall and along the first air pathway when the switching mechanism is in the first position. When the switching mechanism is in the second position, the second airflow may overcome the effect of the step and the curved inlet surface such that the first airflow is deflected and passes along the second air pathway.

The nozzle body may comprise a first air channel configured to deliver the first airflow from the air inlet to the first inlet of the air outlet section, and a second air channel configured to deliver the second airflow from the air inlet to the second inlet of the air outlet section. This may provide a simple way to provide two airflows to the air outlet section from a single airflow generator.

The first and second channels may be fluidly separated from one another. This may allow the first and second airflows to undergo one or more airflow treatments as the first and second airflows pass along the respective first and second channels. For example, the fan assembly may comprise one or more of a heater, humidifier, de-humidifier, purifier configured to treat the first airflow in the first channel.

The airflow generator may be a first airflow generator for generating the first airflow, and the fan assembly may comprise a second airflow generator for generating the second airflow, wherein the switching member may be configured to selectively cause the second airflow generator to generate the second airflow. This may allow more design flexibility and/or may reduce energy consumption by the fan assembly when the switching member is in the first position.

The switching member may be configured to block the second channel when the switching member is in the second position. This may provide a simple mechanism for selectively permitting the second airflow to pass through the second inlet. For example, the switching member may comprise a cover for selectively blocking an end of the second channel, wherein, when the cover is preventing the second airflow from flowing along the second channel, the switching member is in the first position and when the cover is permitting the second airflow to flow along the second channel, the switching member is in the second position. The switching member may comprise a stepper motor for moving the cover to switch the switching mechanism between the first and second positions.

The nozzle may comprise a heater for selectively heating the first airflow such that, in use of the heater, the first airflow is heated to a greater temperature than a temperature of the second airflow. For example, the heater may be positioned in the first air channel such that only the first airflow is heated by the heater as is passes from the air inlet to the first air inlet. Provision of the heater may increase a number of operating modes of the fan assembly.

The air outlet section may comprise an outer wall extending around and separated from the chamber, a third inlet through which a portion of the first airflow passes, and a third air pathway between the third inlet and the air outlet. The third air pathway may be defined by the outer wall and extend alongside at least one of the first and second air pathways. The third air pathway may thus act as an air blanket between the first and/or second air pathway and the outer wall.

The third inlet may be upstream of the heater such that, in use of the heater, the portion of the first airflow that passes along the third air pathway is at a lower temperature that a remainder of the first airflow that is heated by the heater and passes along the first or second air pathway. This may prevent the hottest airflow passing through the air outlet section from coming into contact with the outer wall, which may increase the safety of the product by helping to prevent heating of the outer wall, to which a user may have access.

The nozzle body may be substantially annular and define a central bore. For example, the nozzle body may be substantially round, or in the shape of a racetrack. It has been found that such shapes can help, in some operating modes of the fan assembly, to entrain ambient air through the central bore to provide a more diffused air profile to a user. The first outlet direction may be towards a central axis of the bore, and the second outlet direction may be away from the central axis of the bore. This may provide more certainty to a user of a direction of airflow emitted from the air outlet when the switching member is in the first or second position.

The air outlet may extend annularly around at least a portion of the nozzle body. For example, the air outlet may be in the form or a curved longitudinal slot. This may help to provide a desirable air profile to a user. This may help to increase a flow rate of air emitted from the air outlet whilst maintaining a desired air velocity.

The nozzle may comprise two or more air outlet sections defined in substantially opposing sides of the nozzle body. The air outlet section may be oriented in opposite directions relative to one another such that, when the switching mechanism is in the first position, airflow emitted from the respective air outlets converges, and when the switching mechanism is in the second position, airflow emitted from the respective air outlets diverges. It will be appreciated that, in other examples, when the switching mechanism is in the first position, airflow emitted from the respective air outlets diverges, and when the switching mechanism is in the second position, airflow emitted from the respective air outlets converges. Accordingly, the fan assembly may be operable to provide a concentrated airflow to a user when the switching mechanism is in the first switch position, and a more diffused airflow to a user when the switching mechanism is in the second switch position.

The airflow emitted from the respective air outlets may converge on the central axis of the bore. This may provide certainty to a user on the location and direction of the converges airflows. The airflow emitted from the respective air outlets may converge at a distance of between 1 m and 2 m from the nozzle body.

The nozzle may comprise a single switching mechanism for selectively permitting the second airflow to pass to the two or more air outlet sections. For example, the switching mechanism may be located at or near the air inlet. This may provide a simple assembly. Alternatively, the nozzle may comprise a switching mechanism for each respective air outlet section. This may increase the functionality of the fan assembly.

The nozzle may comprise additional air outlets configured to emit airflow from the fan assembly in a direction such that, when the switching member is in the first position, the airflow emitted from the additional air outlets converges with the airflow emitted from the air outlets. The additional air outlets may be fixed outlets each configured to emit airflow from the fan assembly in a single direction.

BRIEF DESCRIPTION OF THE DRAWINGS

Preferred features of the invention will now be described, by way of example only, with reference to the accompanying drawings, in which.

DETAILED DESCRIPTION OF THE INVENTION

Figure 1:
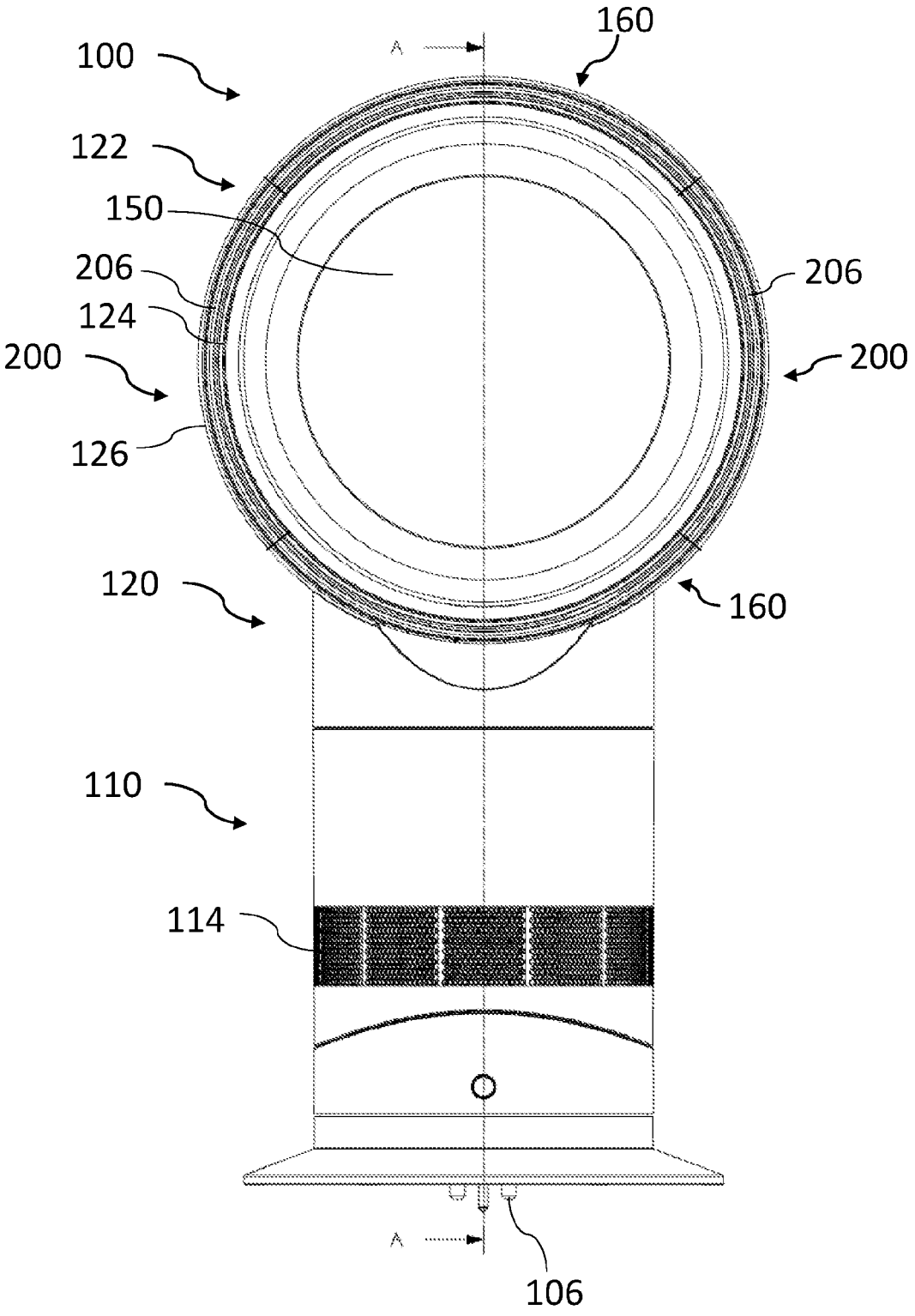
FIG. 1 shows a front view illustrating a fan assembly according to the present invention.
Figure 2:
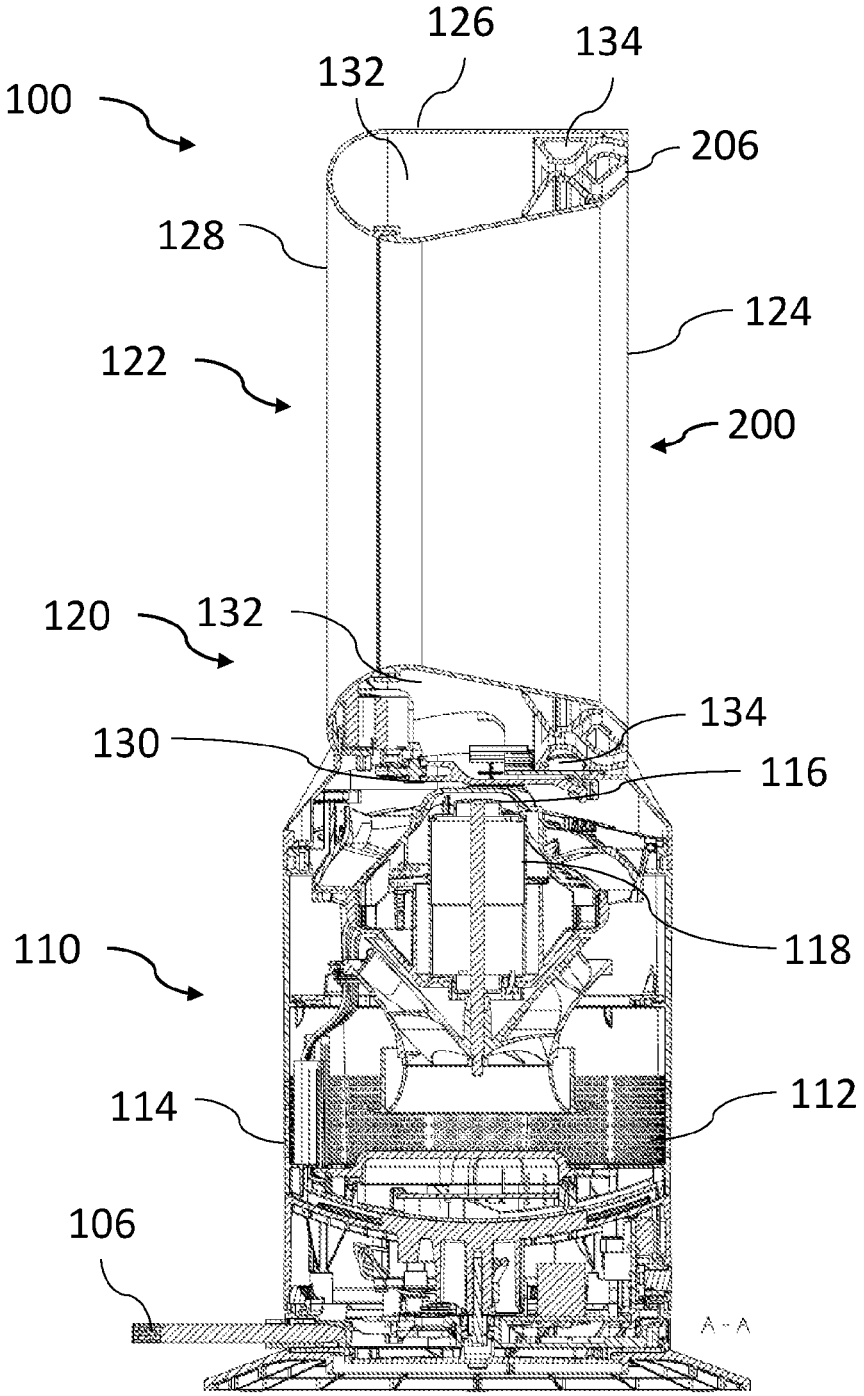
FIG. 2 shows a side cross-sectional view of the fan assembly of FIG. 1.

There will now be described a fan assembly that can deliver either a focused or diffused airflow, and in doing so provide the user of fan assembly with a plurality of options as to how air is delivered by the fan assembly. The term "fan assembly" as used herein refers to a fan assembly configured to generate and deliver an airflow for the purposes of thermal comfort and/or environmental or climate control. Such a fan assembly may be capable of generating a treated airflow, for example one or more of a dehumidified airflow, a humidified airflow, a purified airflow, a filtered airflow, a cooled airflow, and a heated airflow.

FIGS. 1 to 7 show various views of a fan assembly 100, or parts of the fan assembly 100. The fan assembly 100 comprises a body or stand 110 comprising an air inlet 112 through which airflow enters the stand 110, at least one filter assembly 114 mounted on the stand 110 over the air inlet 112, an air outlet 116 through which airflow exits the stand 110 and a nozzle 120 mounted on the stand 110 and arranged to receive the airflow exiting the air outlet 116. The stand 110 also comprises an airflow generator 118 arranged to generate an airflow, the airflow being drawn through the stand 110 and into the nozzle 120 in use. The fan assembly 100 is powered by mains power via a mains power cable 106. It will be appreciated that in other examples, the fan assembly may be powered by any other suitable means, for example one or more batteries.

The nozzle 120 comprises a nozzle body 122 in the form of a round portion of the nozzle 120. The nozzle body 122 has a front side 124, a rear side 128 and an outer wall 126. The round portion defines a central bore 150 extending through the nozzle body 122 from the front side 124 to the rear side 128. It will be appreciated that in other examples, the nozzle body 122 may be in the form of any other suitable shape, for example an elliptical or racetrack portion.

The nozzle 120 defines an air inlet 130 fluidly connected to the air outlet 116 of the stand 110 and arranged to receive the airflow generated by the airflow generator 118 into the nozzle body 122.

The nozzle 120 comprises two air outlet sections 200 defined in the nozzle body 122. In this example, the two air outlet sections 200 are disposed on diametrically opposite sides of the nozzle body 122 and configured to emit air from the front side 124 of the nozzle body 122. It will be appreciated that in other examples, the two air outlet sections 200 may be otherwise relatively positioned, or the fan assembly 100 may comprise one or more than two air outlet sections 200.

The nozzle 120 comprises a first channel 132 extending from the air inlet 130 to the air outlet sections 200 and configured, in use, to deliver a first airflow from the air inlet 130 to the air outlet sections 200. The nozzle comprises a second channel 134 extending from the air inlet 130 to the air outlet sections 200 and configured, in use, to deliver a second airflow from the air inlet 130 to the air outlet sections 200. The first and second channels 132, 134 are fluidly separated from one another. It will be appreciated that in other embodiments, the fan assembly 100 may comprise first and second air flow generators 118 for generating an airflow for the respective first and second channel 132, 134.

Figure 6:
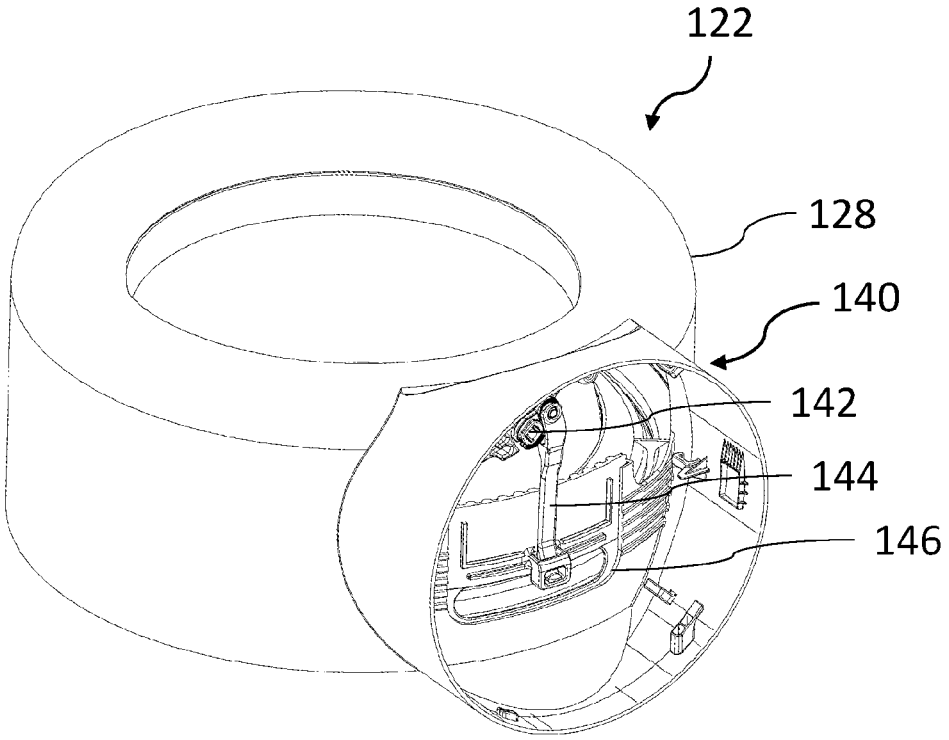
FIG. 6 shows a perspective bottom view of a nozzle of the fan assembly of FIG. 1.

The nozzle 120 comprises a switching mechanism 140 (best shown in FIG. 6) switchable between a first position, in which only the first airflow is delivered to the air outlet sections 200, and a second position in which the first airflow and the second airflow are delivered to the air outlet sections 200. The switching mechanism 140 comprises a stepper motor 142 connected by a linkage 144 to a cover 146 for selectively blocking an inlet of the second channel 134. In use, the stepper motor 142 causes the cover 146 to move between a position in which the second channel 134 is blocked so that the switching mechanism 140 is in the first position (as shown in FIG. 6), and a position in which the second channel 134 is not blocked so that the switching mechanism 140 is in the second position and the second airflow can flow along the second channel 134 to the air outlet sections 200.

Figure 3:
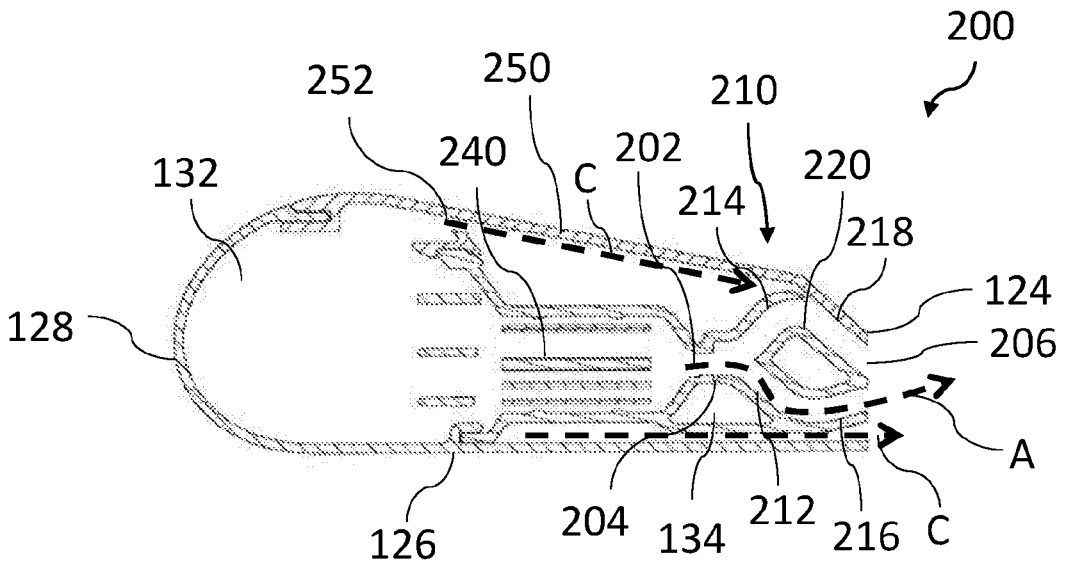
FIG. 3 shows a cross-sectional view of the fan assembly of FIG. 1 in a first configuration.
Figure 4:
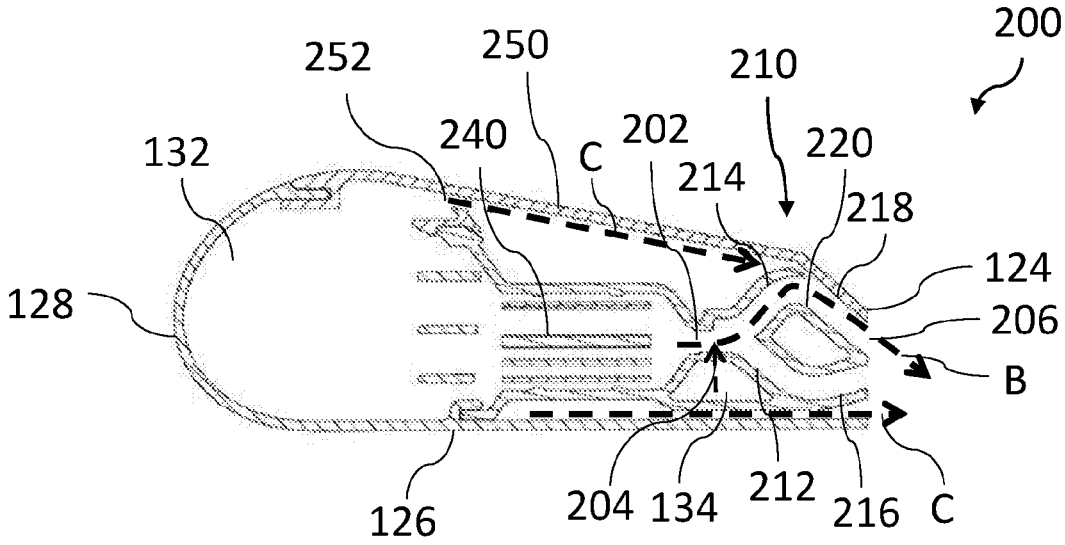
FIG. 4 shows a cross-sectional view of the fan assembly of FIG. 1 in a second configuration.

FIGS. 3 and 4 show a cross-sectional view of one of the air outlet sections 200 of the nozzle body 122. In FIG. 3, the switching mechanism 140 is in the first position and in FIG. 4, the switching mechanism 140 is in the second position.

The air outlet sections 200 each comprise a first inlet 202 through which the first airflow passes from the first channel 132 and a second inlet 204 through which the second airflow passes from the second channel 134 when the switching mechanism 140 is in the second position. The first inlet 202 has a greater cross-sectional area than the second inlet 204. In this example, the first and second inlets 202 have substantially the same length and the first inlet 202 has a width in the region of 1 mm-5 mm and the second inlet 204 has a smaller width than the first inlet 202, for example in the region of 0.5 mm-2.5 mm. When the switching member is in the second position, a flow rate of the second airflow is no more than 10% of a flow rate of the first airflow.

The air outlet sections 200 each comprise an air outlet 206 for emitting airflow from the fan assembly 100, and first and second air pathways, denoted in FIGS. 3 and 4 by respective dashed arrows A and B, between the first inlet 202 and the air outlet 206. When the switching member 140 is in the first position, the first airflow passes from the first inlet 202, along the first air pathway A, and is emitted from the air outlet 206 in a first outlet direction (as denoted by the direction of arrow A in FIG. 3).

The second inlet 204 is arranged relative to the first inlet 202 such that, when the switching member 140 is in the second position, the second airflow collides with the first airflow in a direction perpendicular to the first airflow, as shown in FIG. 4. Accordingly, when the switching member is in the second position, the first airflow passes from the first inlet 202, along the second air pathway B, and is emitted from the air outlet 206 in a second outlet direction (as denoted by the direction of arrow B in FIG. 4).

The air outlet sections 200 each comprise a chamber 210 between the first inlet 202 and the air outlet 206. The chamber 210 is delimited by four walls 212, 214, 216, 218. First wall 212 and second wall 214 extend downstream of the first inlet 202 and diverge from one another. Third wall 216 and fourth wall 218 extend downstream of the respective first and second walls 212, 214 and converge relative to one another towards the air outlet 206. The first wall 212 and the third wall 216 define part of the first air pathway A such that, when the switching member 140 is in the first position, the first airflow passes along the first and third walls 212, 216. The second wall 214 and the fourth wall 218 define part of the second air pathway B such that, when the switching member 140 is in the second position, the first airflow passes along the second and fourth walls 214, 218.

Figure 5:
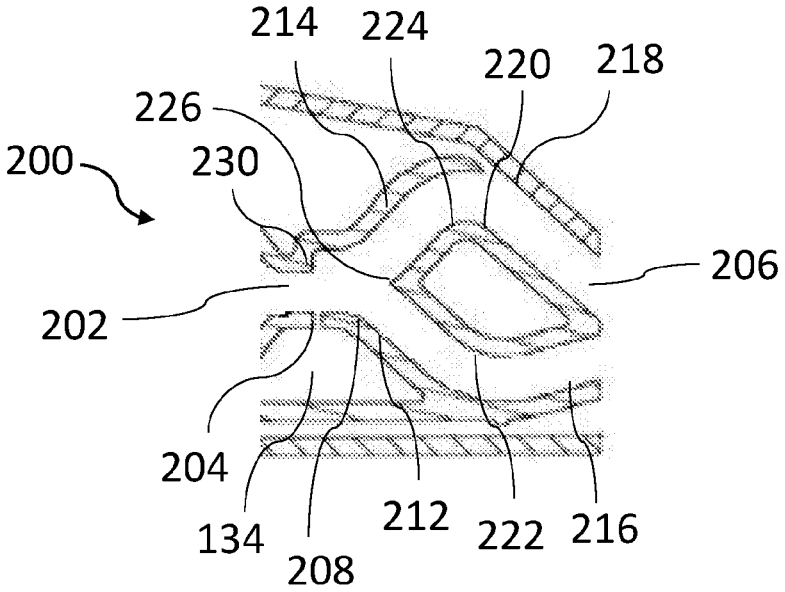
FIG. 5 shows a cross-section view of the fan assembly of FIG. 1.

FIG. 5 shows a cross-sectional view of a portion of the air outlet section 200 shown in FIGS. 3 and 4. The air outlet section 200 comprises a curved inlet surface 208 extending from the first inlet 202 to the first wall 212. The curved inlet surface 208 is configured to generate a force to attract the first airflow toward the curved inlet surface 208 and, in turn, encourage the first airflow to pass along the first air pathway A. The curved inlet surface 208 is a Coanda surface.

An island 220 is located in the chamber 210 and is spaced from the walls 212, 214, 216, 218. The island 220 is configured such that a first side of the island 220 defines part of the first air pathway A and a second, opposing side of the island 220 forms part of the second air pathway B. The first air pathway A then passes around the island 220 in a first direction, and the second air pathway B passes around the island 200 in a second direction. In use, the island 220 guides the first airflow to the air outlet 206 such that the first airflow exits the fan assembly 100 via the air outlet 206 in a direction that is dependent on a position of the switching member 140. The island 220 is substantially aligned with the first inlet 202 and the air outlet 206 such that island 220 prohibits a line of sight from the air outlet 206 to the first inlet 202.

The first side of the island comprises a first curved surface 222 across which the first airflow flows as it passes along the first air pathway A. The first curved surface 222 is configured to generate a first force to attract the first airflow toward the first curved surface 222. The first curved surface 222 is a Coanda surface. The second side of the island comprises a second curved surface 224 across which the first airflow flows as it passes along the second air pathway B. The second curved surface 224 is configured to generate a second force to attract the first airflow toward the second curved surface 224. The second curved surface 224 is a Coanda surface.

The air outlet section 202 comprises a step 230 located on the second wall 214. The step is configured to encourage the first airflow to pass along the first air pathway A. The step 230 causes a rapid increase in the width of the air pathway immediately downstream of the first inlet 202, which further encourages the first airflow to towards the curved inlet surface 208, and thus the first air pathway A, when the switching member 140 is in the first position. The step 230 has a height that is no larger than a width of the first inlet 202. In this example, the step 230 has a height in the region of 1 mm-5 mm. A distance between the step 230 and a leading edge 226 of the island 220 is at least two times greater than a width of the first inlet 202. In this example, the distance between the step 230 and the leading edge of the island 220 is in the region of 4 mm-20 mm.

The leading edge 226 of the island 220 is offset from a centre of the first inlet 202 to further encourage the first airflow towards the first air pathway A when the switching member is in the first position.

A distance between the first side of the island 220 and the third wall 216 is smaller than a distance between the second side of the island 220 and the fourth wall 218. Accordingly, at the air outlet 206, the cross-sectional area of the first air pathway A is smaller than a cross-sectional area of the second air pathway B such that air is emitted from the air outlet 206 in the first air outlet direction at a greater velocity than air that is emitted from the air outlet 206 in the second air outlet direction.

The nozzle 120 comprises a heater 240 for selectively heating the first airflow such that, in use of the heater 240, the first airflow is heated to a greater temperature than a temperature of the second airflow. In this example, the heater 240 is located between the first air channel 132 and the first inlet 202 such that the first airflow is heated shortly before it is emitted from the fan assembly 100 via the air outlet 206.

The air outlet sections 200 each comprise an outer wall 126, 250 extending around the chamber 210 and the heater 240. A third inlet 252 is positioned between the first channel 132 and the air outlet 206, through which a portion of the first airflow passes. The third inlet 252 is upstream of the heater 240 such that, in use of the heater 240, the portion of the first airflow that passes through the third inlet 252 is at a lower temperature than a remainder of the first airflow. A third air pathway C is defined by the outer wall 126, 250 and extends from the third inlet 252 towards the air outlet 206. The third air pathway C extends alongside the first and second air pathways A, B to provide an air blanket between the first and second air pathways A, B and the outer wall 126, 250. In this example, the third air pathway extends from the third inlet 252 to a slot between the second and fourth walls 214, 218 and to the air outlet 206. Although not shown in FIGS. 3 and 4, the third inlet 252 is substantially annular and extends around substantially all of the heater 240 such that the third air pathway C extends around substantially all of the heater 240.

As shown in FIG. 1, the air outlet 206 of each air outlet section 200 extends annularly around approximately a quarter of the nozzle body 122. It will be appreciated that in other examples, the air outlet 206 may extend annularly around the nozzle body 122 by any suitable amount to provide a desirable airflow to a user.

The fan assembly 100 shown in FIGS. 1-7 comprises two additional air outlets 160 on opposing sides of the nozzle body 122 and at approximately 90 degrees to the air outlet sections 200. The additional air outlets 160 are fixed air outlets configured to direct airflow towards a central axis 152 of the central bore 150, as best denoted by dashed arrows D in FIG. 7. The respective airflows emitted by the additional air outlets 160 converge substantially on the central axis 152 at a distance of between 0.5 m-2 m from the front surface 124 of the nozzle body 122.

Figure 7:
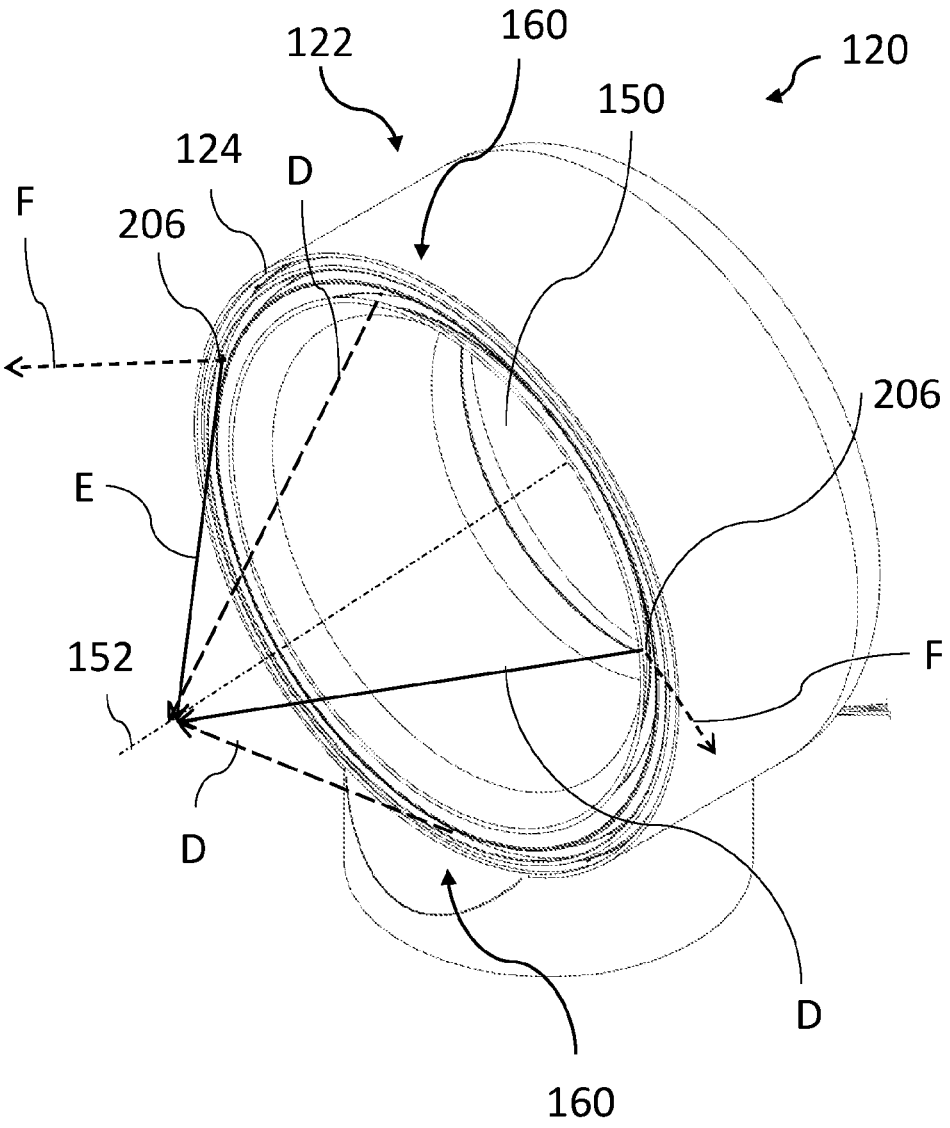
FIG. 7 shows a perspective front view of the nozzle of FIG. 6.

When the switching member 140 is in the first position, the first airflows emitted from the two air outlet sections 200 converge substantially on the central axis 152 at a distance of between 0.5 m-2 m from the front surface 124 of the nozzle body 122, as best denoted by the solid arrows E in FIG. 7. In this example, the airflows D, E emitted all converge with one another at substantially the same distance from the front surface 24.

With the switching member 140 in the second position, the first airflows emitted from the two air outlet sections 200 are directed away from the central axis 152, for example in a substantially forward direction parallel to the central axis 152, or between 0 and 45 degrees away from a direction parallel to the central axis 152. In this example, when the switching member 140 is in the second position, the first airflows diverge from one another, as best denoted by the dashed arrows F in FIG. 7.

The above embodiments are to be understood as illustrative examples of the invention. Further embodiments of the invention are envisaged. For example, the fan assembly 100 may comprise one air outlet section 200, or more than two air outlet sections 200. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. A fan assembly comprising:

an airflow generator to generate an airflow; and a nozzle comprising: a nozzle body defining an air inlet to receive the airflow generated by the airflow generator into the nozzle body, an air outlet section defined in the nozzle body, and a switching member switchable between a first position in which only a first airflow is delivered to the air outlet section, and a second position in which the first airflow and a second airflow are delivered to the air outlet section;

wherein:

the air outlet section comprises a first inlet through which the first airflow passes, a second inlet through which the second airflow passes, an air outlet for emitting airflow from the fan assembly, and first and second air pathways between the first inlet and the air outlet;

when the switching member is in the first position, the first airflow passes along the first air pathway and is emitted from the air outlet in a first outlet direction; and when the switching member is in the second position, the second airflow interacts with the first airflow to cause the first airflow to pass along the second air pathway, and the first airflow is emitted from the air outlet in a second, different outlet direction.

2. The fan assembly according to claim 1, wherein, when the switching member is in the second position, the second airflow collides with the first airflow in a direction perpendicular to the first airflow.

3. The fan assembly according to claim 1, wherein the first inlet has a greater cross-sectional area than the second inlet.

4. The fan assembly according to claim 1, wherein, when the switching member is in the second position, a flow rate of the second airflow is no more than 10% of a flow rate of the first airflow.

5. The fan assembly according to claim 1, wherein the air outlet section comprises a chamber between the first inlet and the air outlet, the chamber delimited by at least two walls, and an island located in the chamber and spaced apart from the at least two walls, wherein the island is configured such that a first side of the island forms part of the first air pathway and the first air pathway passes around the island in a first direction, and a second, opposing side of the island forms part of the second air pathway and the second air pathway passes around the island in a second direction.

6. The fan assembly according to claim 5, wherein the first side of the island comprises a first curved surface across which the first airflow flows as it passes along the first air pathway, the first curved surface configured to generate a first force to attract the first airflow toward the first curved surface, and the second side of the island comprises a second curved surface across which the first airflow flows as it passes along the second air pathway, the second curved surface configured to generate a second force to attract the first airflow toward the second curved surface.

7. The fan assembly according to claim 5, wherein the at least two walls comprise first and second walls extending downstream of the first inlet and diverging from one another, the first wall forming part of the first air pathway and the second wall forming part of the second air pathway such that, when the switching member is in the first position, the first airflow passes along the first wall and, when the switching member is in the second position, the first airflow passes along the second wall.

8. The fan assembly according to claim 7, wherein the air outlet section comprises a curved inlet surface extending from the first inlet to the first wall, the curved inlet surface configured to encourage the first airflow to pass along the first air pathway.

9. The fan assembly according to claim 7, wherein the air outlet section comprises a step located on the second wall, the step configured to encourage the first airflow to pass along the first air pathway.

10. The fan assembly according to claim 5, wherein the at least two walls comprise third and fourth walls converging relative to one another towards the air outlet.

11. The fan assembly according to claim 5, wherein the nozzle comprises a heater for selectively heating the first airflow such that, in use of the heater, the first airflow is heated to a greater temperature than a temperature of the second airflow.

12. The fan assembly according to claim 11, wherein the air outlet section comprises an outer wall extending around the chamber, a third inlet through which a portion of the first airflow passes, and a third air pathway between the third inlet and the air outlet, wherein the third air pathway is defined by the outer wall and extends alongside at least one of the first and second air pathways, and wherein the third inlet is upstream of the heater such that, in use of the heater, the portion of the first airflow is at a lower temperature than a remainder of the first airflow.

13. The fan assembly according to claim 1, wherein the nozzle body comprises a first air channel configured to deliver the first airflow from the air inlet to the first inlet of the air outlet section, and a second air channel configured to deliver the second airflow from the air inlet to the second inlet of the air outlet section, wherein the first and second channels are fluidly separated from one another, and wherein the switching member is configured to block the second channel when the switching member is in the second position.

14. The fan assembly according to claim 1, wherein the nozzle body is substantially annular and defines a central bore, and the first outlet direction is towards a central axis of the central bore, and the second outlet direction is away from the central axis of the central bore.

15. The fan assembly according to claim 14, wherein the air outlet extends annularly around at least a portion of the nozzle body.

16. The fan assembly according to claim 1, wherein the nozzle comprises two air outlet sections defined in substantially opposing sides of the nozzle body, wherein, when the switching member is in the first position, airflow emitted from the respective air outlets converges, and when the switching member is in the second position, airflow emitted from the respective air outlets diverges.

* * * * *